US005765293A

United States Patent [19]

St. Louis et al.

[11] Patent Number: 5,765,293

[45] Date of Patent: Jun. 16, 1998

[54] METHOD FOR PROCESSING PAINT SLUDGE

[75] Inventors: Daniel M. St. Louis, West Bloomfield; Jeffrey C. Johnson, Beverly Hills, both of Mich.

[73] Assignee: Haden, Inc., Auburn Hills, Mich.

[21] Appl. No.: 815,689

[22] Filed: Mar. 12, 1997

[51] Int. Cl.[6] ..... F26B 5/06

[52] U.S. Cl. ..... 34/305; 34/334; 34/347; 34/386; 210/667

[58] Field of Search ..... 34/303, 305, 334, 34/346, 347, 356, 378, 386, 406, 408, 179, 181; 210/667, 609, 710, 742, 751, 770; 106/697; 203/29, 50

[56] References Cited

U.S. PATENT DOCUMENTS 4,876,802 10/1989 Gergely et al. ..... 34/408
5,160,628 11/1992 Gerace et al. ..... 210/667
5,254,263 10/1993 Gerace et al. ..... 210/667
5,490,907 2/1996 Weinwurm et al. ..... 203/29
5,573,587 11/1996 St. Louis ..... 106/697

FOREIGN PATENT DOCUMENTS 08 000 916 1/1996 Japan .

*Primary Examiner*—Harold Joyce
*Assistant Examiner*—Steve Gravini
*Attorney, Agent, or Firm*—Niro, Scavone, Haller & Niro

[57] ABSTRACT

A process for treating paint sludge in which previously cured paint sludge powder is used as a diluent and mixed with wet paint sludge. The paint powder/sludge mixture is agitated and heated to cure the paint sludge. Processing can occur either continuously or in batch mode, and can be accomplished using a mixer charged with heated gases, or a heated mixer.

13 Claims, 3 Drawing Sheets

METHOD FOR PROCESSING PAINT SLUDGE

BACKGROUND OF THE INVENTION

The present invention relates to a method for treating paint sludge having both solid and liquid components. More specifically, the present invention relates to a drying and curing treatment for processing waste paint sludge into a dried powder which is suitable for recycling or convenient disposal.

For many years now environmental interests have sought to limit the type and quantity of industrial waste, including paint sludge. In response, manufacturers have developed various methods for treating paint sludge and creating useful byproducts from it.

One principal and troublesome source of paint sludge is the automotive industry. When an automobile is painted in a paint booth, for example, the excess paint solids are collected, typically in a wet booth or a water-wash system. The effluent from such systems is a dilute mixture of water, paint resins, detackifying compounds and other minor constituents. A majority of the water from this effluent is recovered for reuse in the wet booth, leaving a relatively thick and viscous paint sludge.

It will be appreciated by those skilled in the art that the waste paint sludge treated in accordance with the present invention is a complex material and is different from most other waste sludges. For example, paint sludge includes a variety of polymeric resins, volatile organic compounds ("VOC's"), such as thinners and solvents, as well as detackifying agents and flocculants. The resident polymeric paint resins are uncured and in a liquid or semi-liquid phase. These resins can "cure" or cross-link upon the heating and volatilization of the constituent liquid components. Paint sludges may also include inorganic pigments and heavy metals. These components are often hazardous and/or toxic.

Disposal of paint sludge is a problem of considerable complexity. Various kinds of sophisticated equipment have been used to process paint sludge. Currently available disposal technology is based upon the principles of incineration, chemical and physical treatment, and solidification, as discussed in U.S. Pat. Nos. 4,750,274 and 4,980,030, hereby incorporated by reference. The equipment disclosed in these patents has met with considerable commercial success, although this equipment is relatively expensive to construct, operate and maintain.

Prior art methods for drying paint sludge have relied upon specially designed drying methods. A machine known to perform adequately is the assignee's own DRYPURE® drier, described in U.S. Pat. No. 4,750,274, which uses a hollow flight screw mixer heated with hot oil. The operation of this equipment requires the use of a suitable scouring aggregate such as small stone chips or gravel.

The DRYPURE® process has been a commercial success. However, the DRYPURE® machine is relatively expensive. It is also susceptible to the operational problem that the paint sludge can transform into an extremely viscous "sticky phase" that can lock up the machine. When heated paint sludge is in the sticky phase, it has the consistency of taffy with excessively high cohesive and adhesive properties, and if allowed to cool in this condition, the sludge will "set" into a solid mass. This phenomenon can also damage drier or mixer components, and once transformed to this sticky phase, the sludge can only be removed from the processing equipment in a laborious fashion. In the past it has been difficult to prevent sludge transformation to the sticky phase in a predictable and consistent manner. While use of the scouring aggregate in the DRYPURE® process addresses this problem, removal and disposal of the aggregate is difficult and increases the costs of the process.

Known thermal techniques for processing paint sludge also require significant warm-up times and corresponding cool-down times, due to their relatively large thermal mass. For example, with the screw mixer disclosed in U.S. Pat. No. 4,750,274, the "thermal mass" (i.e., the mass that must be heated to heat the sludge) includes a good deal of equipment and system components unrelated to the sludge, including oil tanks, piping, jackets containing oil, etc.

A further problem associated with known thermal drying techniques for processing paint sludge is their relatively high operational and maintenance costs.

With treatment systems other than those involving paint sludge, it has also been known to back-mix wet or sticky materials with dry materials to facilitate drying. However, it is not believed that curing of the material to be treated has been accomplished with such systems.

Accordingly, it is an object of the present invention to provide an efficient, simple and economical thermal drying device and technique for processing paint sludge.

It is also an object of the invention to provide a paint sludge processing technique which does not require disposal or replacement of a scouring aggregate.

Another important object of the invention is to provide a method for processing paint sludge into a fully dried, frangible and cured powder, while minimizing sludge transformation into the sticky phase and its deleterious effects.

These and other objects and advantages of the present invention will become apparent to those of ordinary skill in the art from a reading of the following description of the preferred embodiments and the appended claims.

SUMMARY OF THE INVENTION

The present invention satisfies these and other objects, while also preserving the advantages of known methods for processing paint sludge, and avoiding the disadvantages associated with such methods.

The process of the present invention for treating paint sludge includes the use of a dried and cured powder derived from previously processed paint sludge. The cured powder is mixed with the paint sludge to be processed within a containment vessel to form a powder/sludge mixture. The mixture is heated, preferably within a substantially inert environment, at a temperature and for a time sufficient to cure the polymeric paint resin and to volatilize water and VOCs present in the sludge. The mixture is agitated during heating in a manner that will promote adequate mixing and heat transfer without substantially increasing the cohesive and adhesive properties of the mixture.

In a preferred embodiment, cured powder is mixed with an incoming stream of paint sludge continuously, and removal of the cured powder is done periodically, while still maintaining a minimum powder treatment amount within the containment vessel. At the end of a day or shift, for example, no further sludge is added, and the remaining mixture within the vessel is heated for a sufficient time to ensure that the last portion of paint sludge added to the vessel has been fully cured.

In another embodiment, cured paint powder is mixed with paint sludge to be treated in a mixing vessel, and the powder/sludge mixture is then transported (by a screw conveyor, for example) into a second containment vessel.

This second vessel may be a drier, such as a heated mixer, or may instead be a fluidized bed, for example. Further agitation and continued heating, or combinations of these processing procedures may be accomplished in yet another containment vessel.

The powder/sludge mixture preferably has a "powder/sludge ratio" which is at least 1 part by weight of cured powder to about 1 part by weight of paint sludge, or 1:1. Preferably the powder/sludge ratio is at least 3:1, and may be much greater, such as 10:1 or even greater, depending upon the throughput required, the equipment used, the type of sludge processed, and whether the process is performed in a continuous or batch mode. Obviously, when the system is operated in the continuous mode this ratio will vary unless a "steady state condition" is reached, which is defined here as the point in the process at which the rate of sludge added to the mixer is equal to the rate at which the sludge is curing within the mixer. If the process is performed in a step-by-step "batch" mode, the powder sludge ratio is preferably between about 2:1 and 10:1.

To obtain a cured powder end product, the powder/sludge mixture is preferably heated to a temperature of at least about 400° F. within the containment vessel, for a time period of between about 30 minutes and one hour, prior to removal of any of the cured powder from the containment vessel.

Heating of the mixture can be accomplished through direct contact with a heated gas such as steam, or through indirect heating (e.g., using a heated mixer). An insulated paddle mixer is preferred, and provides sufficient agitation so that good heat exchange contact is achieved between the paint powder/sludge mixture and the heated gases, without providing excessive shearing forces which can induce transformation to the paste-like sticky phase with excessive cohesive and adhesive properties.

Gases generated by heating the paint sludge may be incinerated/oxidized, and the hot exhaust may be recovered and provided to a heat exchanger to enhance efficiency. These gases may also be condensed, and the resulting condensate may be treated or otherwise recirculated or disposed of.

The dried and cured end product from the process may be easily crushed or pulverized to obtain a desired size and consistency, and it can be used as landfill, as a constituent within building materials such as asphalt, or for other purposes.

BRIEF DESCRIPTION OF THE DRAWINGS

The novel features of the invention are set forth in the appended claims. However, the preferred embodiments of the invention, together with its further objects and attendant advantages, will be best understood by reference to the following description taken in conjunction with the accompanying drawings in which:

DETAILED DESCRIPTION OF THE PREFERRED EMBODIMENTS

The preferred embodiment of the present invention utilizes previously dried and fully cured powder that has been processed from wet paint sludge. This cured powder is mixed with wet paint sludge to be processed, and acts as a "curing facilitator" or a diluent to reliably dry and cure the paint sludge and transform it into a non-toxic powder. "Cured" is defined here as a condition in which the paint sludge has been fully dried, with substantially all the volatile constituents being driven off, and the resident paint resins cross-linked sufficiently to prevent any reversion to a liquid, semi-liquid or "plastic" state.

It has been known that at temperatures of less than 300° F., and sometimes as low as 212° F., paint sludge will convert into an apparently cured state. However, it has not previously been understood or appreciated how the presence of spray booth chemicals within paint sludge, such as detackifiers or flocculants, as well as paint sludge agitation, impact paint sludge curing. Detackifying agents, for example, encapsulate the paint droplets in a film, lowering the adhesive properties of the paint. It has now been found that these factors can significantly effect curing, so that higher temperatures and longer heating dwell times are required than was previously thought necessary to induce cross-linking and curing of the paint resin. In fact, the inventors have discovered that temperatures of at least about 400° F. are preferred to adequately cure paint sludge in a reasonable time.

Thus, in accordance with the present invention, the raw paint sludge is mixed with cured powder and thereafter heated, preferably to at least about 400° F., and agitated for a sufficient time to convert the sludge to a fully dried and cured particulate. By mixing the cured powder in the appropriate amounts and by utilizing the appropriate processing conditions, the sludge/powder mixture can be maintained in a generally free-flowing phase that does not agglomerate. In this state, the mixture has relatively low adhesive and cohesive properties and can be readily dried and cured without the problems attendant with sludges in the "sticky" phase.

Figure 1:
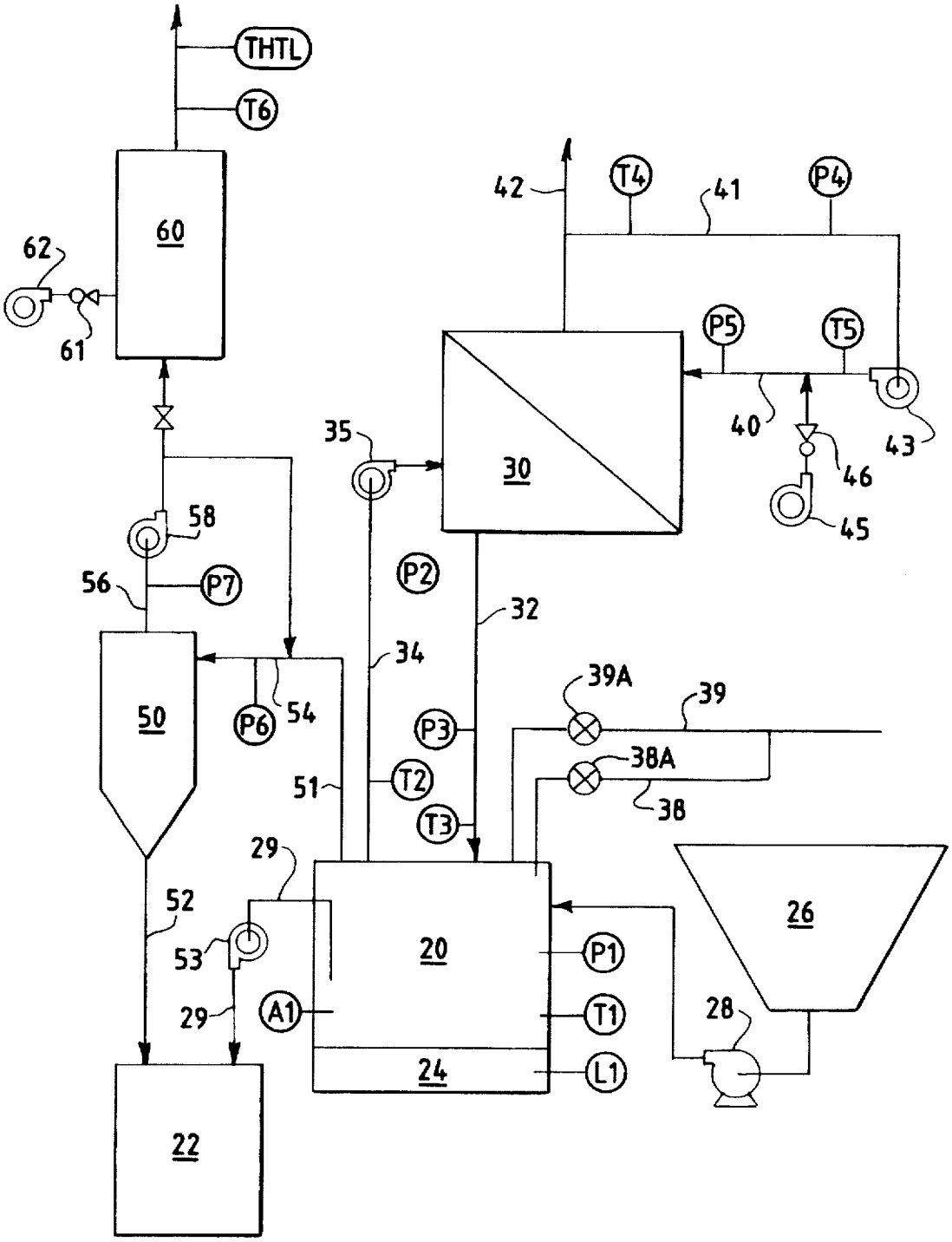
FIG. 1 is a process flow diagram of a preferred embodiment of the method for treating paint sludge in accordance with the present invention.

Referring to FIG. 1, a continuous paint sludge treatment process is shown, and forms a preferred embodiment of the present invention. A predetermined amount of the dried and cured powder is initially supplied to mixer 20 by any expedient means. Wet paint sludge is continuously transported from sludge hopper 26 by sludge pump 28 to mixer 20. The powder/sludge blend within mixer 20 is preferably maintained at a minimum temperature of at least 400° F. While volumes and rates will vary, in a particularly preferred embodiment, mixer 20 may, for example, initially contain 5 cubic yards of dried paint powder as the wet sludge is pumped into the mixer at at rate of 5 gallons/minute, resulting in a total of 7 cubic yards of dried and cured paint powder contained within the mixer at the end of the process following an 8-hour shift. The amount of dried powder contained within the mixer at any point in time is referred to here as the "residual paint powder".

At the end of a day or shift, a predetermined portion of the cured powder is transported from the mixer, via line 29, by pneumatic transportation which allows the powder to cool, and into powder bag station 22. While cured powder can be periodically removed during a shift, for example, a delay of at least one-half hour is required to cure the sludge last added to the mixer; therefore, it has been found advantageous to wait to remove a predetermined portion of the cured powder until the end of a day or shift.

A steam environment is maintained within mixer 20. Lines 38 and 39 provide water spray and fire suppression chemicals, respectively, as needed, using controls 38A, 39A.

The steam is continuously recirculated through mixer 20, and is preferably directed into the mixer while the mixer paddles agitate the sludge to provide good heat exchange. Steam is charged into the mixer via line 32, which leads from heat exchanger 30, while steam exhausts from the mixer via line 34, and is recirculated to heat exchanger 30 by fan 35. Burner 46 adds heat to the air, which is directed via line 40 into the heat exchanger; excess air from the heat exchanger is released to the atmosphere via line 42. Heater recirculation fan 43 and combustion blower 45 are employed to convey the hot air within this portion of the system, as shown. The other effluent stream from mixer 20 includes gases and dust, and passes via line 51 into cyclone 50. Cyclone 50 separates the dust from the gas exhaust, and the dust is conveyed through line 52 back into powder bag station 22, which holds powder from the mixer. The remaining exhaust containing VOCs is conveyed by exhaust blower 58 through line 56 and into thermal oxidizer 60 (maintained at temperatures of between 1400°–1600° F.), which has associated with it burner 61 and air combustion blower 62.

In FIG. 1, T1–T6 indicate the presence of thermocouples for temperature measurement; A1 indicates the presence of a current sensing device; P1–P7 indicate the presence of pressure sensing devices; L1 indicates the presence of a load sensing device (associated with load cell 24); and THTL indicates the presence of a high temperature thermal couple which functions to shut down burner 61 if incinerator 60 reaches a maximum temperature.

As a non-limiting example, a particularly preferred embodiment of the present invention may be practiced using the following parameters: at line 40 (T=1000° F.); at line 41 (T=750° F., 26,320 SCFM); at line 32 (T=800° F., 527.75 lb/min, 26,915.25 SCFM); at line 34 (T=600° F., 527.75 lb/min, 22,169 SCFM; and at line 54 (T=600° F. steam, 2200 lb/min, 1572 SCFM. Burners 46, 61 may be 5 mm BTU/hr and 3.5 mm BTU/hr, respectively. Oxidizer 60 may maintain a temperature of 1600° F. at a 1 second dwell, and combustion blower 62 may provide 3000 SCFM.

In the continuous paint sludge treatment process depicted in FIG. 1, the weight ratio of dried and cured powder to wet paint sludge within mixer 20 may vary substantially. At the beginning of the treatment, the ratio of cured powder to sludge will be very large. As the treatment progresses, the ratio of cured powder to sludge will optimally reach a steady state condition. At this steady state condition the amount of uncured sludge in the mixer depends on the rate at which sludge is added and the rate at which the sludge is curing. This latter condition is, in turn, dependent upon the powder bed temperature (since a higher temperature results in faster curing). As one example, if at the start of the treatment there is 5 cubic yards of dry cured powder in the mixer (or about 8,000 pounds), and assuming the sludge requires one-half hour to dry and cure, and sludge is pumped into the mixer at a rate of 5 gpm,, this will result in 1,250 pounds of sludge, or a powder/sludge ratio of 6.4:1. Thus, the time/temperature relationship for drying and curing sludge will vary significantly based upon the type of sludge, the throughput required, etc., and this will have a significant effect on the powder/sludge ratio, which must be at least 1:1, but may be 3:1 or even 10:1 or significantly greater.

These temperatures, gas flow rates, sludge pump rate and holding capacities are typical parameters for the preferred embodiment but, obviously, may be varied for different systems depending on the required throughput and type of sludge being processed.

In another embodiment, a step-by-step "batch" mode, the entire wet paint sludge load to be processed is charged to mixer 20 in a single step, and the sludge can be heated and processed in a manner similar to that described above. In the "batch" mode, the powder/sludge ratios may be between 2:1 and 10:1 or greater.

It will be appreciated that the cured paint powder and paint sludge can be mixed in a containment vessel, and then transported by a screw conveyor or other means to a drier for further processing. In either the heated mixer or this latter "premix" embodiment, the mixer can be of various types. As a non-limiting example, a Pugmill mixer having a single shaft with multiple paddles fixed on the shaft can be used, and is available from McCarter Corporation of Norristown, Pa. Preferably, the drier is an insulated, multi-paddle mixer designed to minimize mechanical working of the sludge. During agitation, a blower charges superheated steam into the powder in the same direction as the paddle(s) are directing the powder.

While it will be understood that many different types of equipment and heating alternatives and combinations can be employed using the present invention, mixers which exert lower shear forces on the detackified paint sludge particles, to minimize the exposure of raw paint particles, are preferred. While most commercially available mixers can be used with the present invention, routine testing is first required to ensure that the mixer is operated in a manner and at speeds that do not involve excessive shearing and exposure of the paint sludge resins. Mixer operators must strike a balance between the desire to optimize heat transfer and obtain a homogenous mixture, necessary for proper drying and curing, without causing excessive shearing. As an example, the operator can monitor the consistency of the sludge and the appropriate mixing speed by monitoring the amperage of the mixer motor; the amperage will be proportional to the torque of the paddle(s), which is proportional to the sludge consistency or "stickiness".

With any treatment system for paint sludge there is some minimum baseline amount of cured paint powder or "heel," defined here as the "minimum powder treatment amount," necessary to ensure that the paint sludge being processed will dry and cure correctly. It has been empirically determined that, as a general rule, this minimum powder treatment amount is preferably at least 3 parts of cured powder to 1 part, by weight, of wet paint sludge. Depending on the type of sludge to be treated and the equipment used, however, this ratio may be as low as 1:1, and can certainly be greater than 3:1, as discussed above, within the size constraints of the mixer.

The powder/sludge mixture in the mixer is continuously heated at a temperature of at least 400° F., for at least about 30 minutes, (and with some sludges for up to one hour), to ensure that the paint sludge is cured. These conditions are, of course, also sufficient to drive off all the water and liquid solvents present in the paint sludge. It has been found that curing can occur at temperatures of 375° F., and possibly as low as 350° F. with certain paint sludges. However, the minimum preferable treatment temperature is at least about 400° F. to accommodate a broad range of paint sludges.

Mechanical working of the paint sludge in the powder/sludge mixture must be controlled in accordance with the practice of the present invention so that a minimum number of paint droplets in the powder/sludge mixture are sheared or smeared to expose raw paint. This, in turn, will prevent the paint sludge from transforming into the sticky phase. It is, therefore, important that the agitation of the powder/sludge mixture be limited so that the cohesive and adhesive properties of the mixture do not appreciably increase during heating and drying. Through this careful handling, and by controlling the temperatures and dwell times as indicated here, the paint resins within each discrete paint droplet in the mixture will cross-link and cure, with each droplet forming a hard particle of plastic that will not revert to a liquid or semi-liquid phase.

The "seed batch" of dried and cured powder, necessary for use of the present invention, can be obtained in a number of ways. For example, the process disclosed in U.S. Pat. No. 4,750,274 can be used to treat paint sludge. Alternatively, paint sludge can be treated with chemicals, such as surfactants, or chemically dried with calcium oxide. Alternatively, a suitable particulate such as sand could be used.

To provide a working example of the treatment process of the present invention in the "batch" mode, 500 pounds of cured powder is added to 200 pounds of paint sludge consisting of 80% water, by weight. After the first treatment there will be 540 pounds of powder in the batch. Load cell(s) 24 is positioned beneath the mixer to continuously monitor the weight of the powder/sludge mixer. After the second treatment, again adding 200 pounds of the sludge, there will be 580 pounds of cured powder in the batch. Assuming the maximum powder treatment amount is 1200 pounds of powder, when this maximum amount has been reached, only then must a portion of the dried and cured powder be removed from the batch.

In another example according to the present invention carried out in the "batch" mode, four cubic yards of cured paint powder and one cubic yard of wet paint sludge were mixed and heated, dried and cured as described above. It was found that since the volume of the wet paint sludge will typically be reduced by a factor of five, on completion of the drying cycle 4 and ⅕ cubic yards of cured paint powder was present in the dryer. ⅕ cubic yard of cured paint powder was then removed from the dryer, a new charge of wet paint sludge was added to the dryer, and the process was repeated. The inventor has successfully treated paint sludge according to the present invention using a multi-paddle mixer, and has found, as discussed above, that a preferred heating method is to directly heat the sludge using hot gases charged to the mixer. This improves heat transfer efficiency and overcomes the surface area heating limitation of a heated jacket mixer, discussed immediately below. In a preferred heating method, some of the vapors from the mixer are superheated, using a heat exchanger, and then returned to the mixer.

The present invention is more economical than known sludge treatment systems employing a heated jacket. With the heated jacket mixer, the sludge tends to stick to the walls of the mixer, forming an insulating blanket which interferes with effective heating of the powder. Also, with such prior art systems, to increase the drying power by a factor of two, the machine size needs to be doubled, since the surface area varies linearly with the size of machine. However, with the present invention, the drying power increases with the cubic root of the linear dimension of the mixer. For example, the prior art system disclosed in U.S. Pat. No. 4,750,274, treating the same four cubic feet of paint sludge volume, will need to be sized to accommodate a sludge cube with more than six times the surface area. Since the ratio between volume and surface area continues to increase with the linear sludge dimension, this difference only becomes more dramatic as the size of the system increases. Thus, it can be seen that the present invention provides a great advantage in space savings and overall efficiency compared to known prior art sludge heating systems.

While it will be understood that various heating and processing methods can be used, it is currently believed that a continuous treatment process employing direct heating using an inert or oxygen-free gas is superior to other known methods for practicing the present invention.

In another preferred embodiment, remaining vapors not used for mixing can be collected and condensed into a liquid using appropriate ductwork to direct these vapors to a condenser. This minimizes or eliminates the need for costly air pollution control equipment. The resulting condensate can then be sent to a waste water treatment system.

It will be understood that the cured paint powder can be dried to any desired extent. This may depend on the post-treatment steps or on ultimate use (e.g., recycling sludge back into system, use as landfill, incineration, etc.) to be made of the sludge, since control over material dryness can enhance (for example) sludge recyclability.

Using the present invention, a variety of different paint sludges have been successfully transformed into a dried, frangible and cured powder. It is a robust and reliable technique which is easy to operate and relatively safe. Also, the need for a costly hot oil system with a heated jacket mixer is eliminated, because heating can be accomplished using a gas-fired heat exchanger. Better heat transfer and lower thermal mass also results in faster and more efficient heating and cool-down of the system. As an example, the drier of the present invention requires about 30–45 minutes to heat to an appropriate operating temperature, while the heated jacket system described in U.S. Pat. No. 4,750,274 requires several hours of heating start-up time, to treat the same amount of sludge. Further, the method of the present invention is more compact and requires less floor space than current systems. It is also estimated that the capital costs for building a comparable machine of the present invention are substantially less, and possibly one-half or less, than the capital costs of the machine described in the '274 patent.

Figure 2:
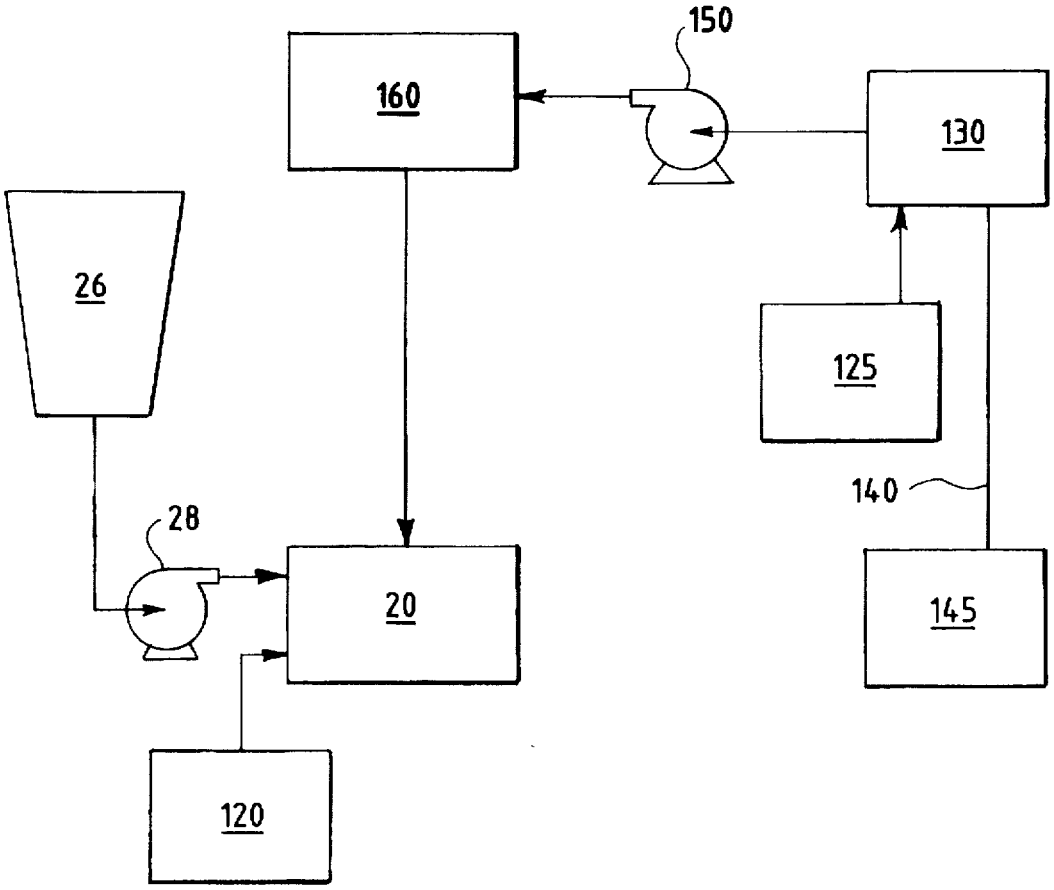
FIG. 2 is a schematic diagram depicting various process steps utilized in the practice of the present invention.

The basic treatment steps of the present invention, when used in the "batch" mode, are illustrated in block diagram form in FIG. 2. First, cured paint powder 120 is blended with wet paint sludge from hopper 26 (conveyed by pump 28) within batch drier/mixer 20. Gas emissions from the mixer can be filtered (step 125) and condensed (step 130). The resulting condensate may be conveyed via condensate drain 140 for disposal in a waste treatment plant or sewer 145; remaining effluent may be conveyed by blower 150 into superheater 160. The superheated gas can be recirculated into mixer 20. Alternatively, it may be preferred to incinerate gas emissions from the mixer, rather than condensing them, for economical reasons. Following drying at the end of a day, a shift, or other appropriate time interval, a portion of the cured paint powder can be removed from the dryer and conveyed to a hopper (not shown). This processed powder can be used as a fuel, as landfill, or for other purposes.

It will be appreciated that the choice of using the "batch" or "continuous" processing mode will depend upon the required throughput of sludge to be processed, the particular equipment chosen, the type of sludge and the use to be made of the sludge.

Figure 3:
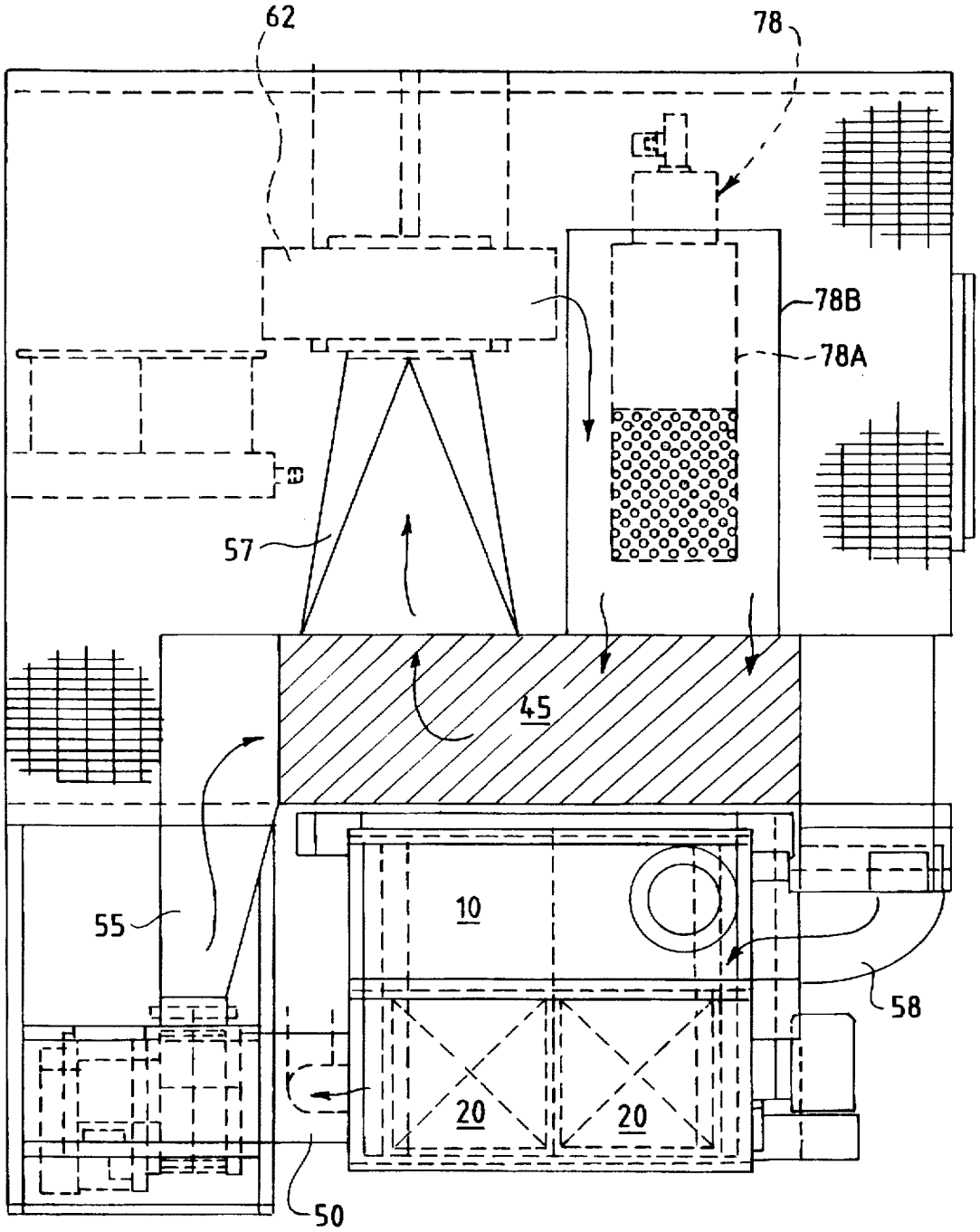
FIG. 3 is a plan view of a preferred embodiment of apparatus useful in the practice of the present invention, including a mixer, heat exchanger, burner, blower and connecting ductwork.

Referring now to FIG. 3, a preferred embodiment of the apparatus of the present invention is shown. On the primary side of heat exchanger 45, hot air circulates from heat exchanger 45, through the ductwork 57, through fan 62, and into burner 78, as indicated by the arrows. Burner 78 includes inner and outer tubes 78A and 78B, respectively, with inner tube 78A being perforated. Hot air passes between tubes 78A and 78B and is directed back to heat exchanger 45, as also indicated by the arrows.

Still referring to FIG. 3, on the secondary side of heat exchanger 45, superheated steam passes through ductwork 58 and into mixer 10, as indicated by the arrow. Filters 20 are positioned above mixer 10, and accept superheated steam from mixer 10. The steam then passes from filters 20, through blower 50 and ductwork 55, and back into heat exchanger 45.

It will be appreciated that the resulting effluents from the process can be used in a variety of ways. Condensate produced from the mixing process can be recycled back to the booth water within the paint spray booth. Cured paint powder from the drier can also be sent to a crusher, where the solids can be pulverized by any means well known in the art. The dried and cured solids can then be conveyed to, for example, a landfill. Alternatively, the cured powder can be used as an ingredient for asphalt, concrete, mastics, sealants and similar materials. The resulting powder from the sludge processed according to the present invention may also find advantageous use as a fuel, due to its BTU value.

The foregoing description of the preferred embodiments of the present invention has been presented for purposes of illustration and description. The described embodiments are not intended to be exhaustive or to limit the invention to the precise form disclosed. Obviously many modifications and variations are possible in light of the above teachings. The embodiments which were described were chosen in order to best explain the principles of the invention and its practical applications. It is therefore intended that the scope of the invention, as defined by the following claims, be interpreted to include all equivalent treatment systems falling within the spirit of the present invention.

We claim:

1. A process for treating paint sludge containing polymeric paint resin, comprising the steps of:

a. mixing a cured powder made from previously processed paint sludge with the paint sludge to form a powder/sludge mixture;

b. heating the mixture within a substantially inert environment for a period of time and to a temperature sufficient to volatilize water and VOCs present within the paint sludge and to cure the paint resin; and c. agitating the mixture during heating in a manner to facilitate heat transfer to the paint sludge without substantially increasing the cohesive and adhesive properties of the mixture.

2. The process of claim 1 for treating paint sludge, wherein the paint sludge is processed continuously.

3. The process of claim 1 for treating paint sludge, wherein the mixture has a powder/sludge ratio which is at least 1 part by weight of cured powder to about 1 part by weight of paint sludge.

4. The process of claim 1 for treating paint sludge, wherein the mixture has a powder/sludge ratio which is at least 3 parts by weight of cured powder to about 1 part by weight of paint sludge.

5. The process of claim 1 for treating paint sludge, wherein the mixture has a powder/sludge ratio greater than 3:1 but less than 10:1.

6. The process of claim 1 for treating paint sludge, wherein the mixture has a powder/sludge ratio greater than 10:1.

7. The process of claim 1 for treating paint sludge, wherein the mixture is heated to a temperature of at least about 400° F.

8. The process of claim 7 for treating paint sludge, wherein the mixture is heated for at least about 30 minutes.

9. The process of claim 1 for treating paint sludge, wherein agitation of the mixture is accomplished using a multi-paddle mixer.

10. The process of claim 1 for treating paint sludge, wherein heating of mixture is accomplished through direct contact with a heated, inert gas.

11. The process of claim 10 for treating paint sludge, wherein the inert gas is steam.

12. The process of claim 1 for treating paint sludge, wherein heating of the mixture is accomplished using a heated mixer.

13. A process for treating paint sludge containing polymeric paint resin, comprising the steps of:

a. mixing a cured powder made from previously processed paint sludge with the paint sludge to form a powder/sludge mixture;

b. heating the mixture for a period of time and to a temperature sufficient to volatilize water and VOCs present within the paint sludge and to cure the paint resin; and c. agitating the mixture during heating in a manner to facilitate heat transfer to the paint sludge without substantially increasing the cohesive and adhesive properties of the mixture.

* * * * *